US005203270A

United States Patent [19]

Price et al.

[11] Patent Number: 5,203,270

[45] Date of Patent: * Apr. 20, 1993

[54] SEWING MACHINE WITH LATCH BACK DEVICE

[75] Inventors: Elvin C. Price, Dacula; Preston B. Dasher, Lawrenceville, both of Ga.

[73] Assignee: Atlanta Attachment Company, Lawrenceville, Ga.

[ * ] Notice: The portion of the term of this patent subsequent to Nov. 3, 2009 has been disclaimed.

[21] Appl. No.: 630,841

[22] Filed: Dec. 20, 1990

[51] Int. Cl.[5] ..... D05B 65/00

[52] U.S. Cl. ..... 112/269.1; 112/288

[58] Field of Search ..... 112/288, 287, 253, 291, 112/292, 293, 294, 295, 296, 297, 298, 300, 285, 269.1, DIG. 1, 130, 129, DIG. 3

[56] References Cited

U.S. PATENT DOCUMENTS

| | | | |
|---|---|---|---|
| 2,579,059 | 12/1951 | Vanadia | 112/252 |
| 3,143,987 | 9/1964 | Daniel et al. | 112/252 |
| 3,215,106 | 11/1964 | Bono | 112/252 |
| 3,223,059 | 12/1965 | Jacobs | 112/288 X |
| 3,320,915 | 5/1967 | Steiner | 112/253 |
| 3,379,151 | 4/1968 | Tiemann | 112/252 |
| 3,448,708 | 6/1969 | Ross | 112/253 |
| 3,490,403 | 1/1970 | Boucraut | 112/252 |
| 3,511,202 | 5/1970 | Strauss et al. | 112/252 |
| 3,548,768 | 10/1970 | Juenemann et al. | 112/252 |
| 3,557,730 | 1/1971 | Armstead | 112/252 |
| 3,581,716 | 6/1971 | Teed | 112/252 |
| 3,624,734 | 11/1971 | Schips | 112/252 |
| 3,688,336 | 9/1972 | Costello, Jr. et al. | 15/256.51 |
| 3,698,336 | 10/1972 | Launer | 112/252 |
| 3,922,983 | 12/1975 | Schips et al. | 112/252 |
| 4,038,933 | 9/1977 | Marforio | 112/288 |
| 4,091,756 | 5/1978 | von Hagen | 112/287 |
| 4,149,478 | 2/1980 | Sanvito et al. | 112/286 |
| 4,187,793 | 2/1980 | Fietta et al. | 112/288 |
| 4,220,105 | 9/1980 | Palacino | 112/287 |
| 4,453,481 | 6/1984 | Garnett et al. | 112/288 |
| 4,599,960 | 7/1986 | Brusasca et al. | 112/287 |
| 4,607,583 | 8/1986 | Biermann et al. | 112/288 X |
| 4,644,884 | 2/1987 | Tatsumi | 112/130 |
| 4,679,515 | 7/1987 | Keeton | 112/276 |
| 4,738,210 | 4/1988 | Keeton | 112/262.1 |
| 4,763,590 | 9/1988 | Kojima et al. | 112/287 |
| 4,829,920 | 5/1989 | Dippert et al. | 112/288 |

*Primary Examiner*—Peter Nerbun
*Attorney, Agent, or Firm*—Hopkins & Thomas

[57] ABSTRACT

An apparatus and method for creating a "serging", "overlock" or "504" stitch wherein the excess thread chain (44) extending from the sewing machine needle to the previously sewn garment part (54) is cut in a manner to create a leading thread chain of a predetermined length extending from the sewing machine needle, and the free end of the leading thread chain is drawn off by a stream of air flowing into a hollow member (31) acting as a chaining tongue (29). The leading thread chain is subsequently progressively withdrawn from the chaining tongue and oversewn into the stitching of a succeeding garment. The hollow member (31) acting as the chaining tongue (29) is integrally formed with the throat plate (21) of the sewing machine (20). A vacuum reservoir (81) is connected to the hollow member (31) to create the air flow through the hollow member to draw the leading thread chain therein.

29 Claims, 3 Drawing Sheets

SEWING MACHINE WITH LATCH BACK DEVICE

TECHNICAL FIELD

This invention relates to overlock stitch sewing machines and attachments therefor, and more specifically to a sewing machine which forms an overlock stitch in its work product with a thread chain extending between adjacent work products. A cutting means cuts the thread chain extending between work products and an attachment forms a "latch back" in the work product of the leftover thread chain which has been severed from the previous work product.

BACKGROUND OF THE INVENTION

In the sewing of garment parts or other work products with a semi-automatic sewing machine that forms a overlock stitch in the garment parts a chain of thread is created which extends from the rear of each garment part back toward the sewing needle by the continuing operation of the sewing machine after the garment parts pass through the machine. This thread chain is formed as the sewing machine continues to operate for a short time after the garment part has passed through the sewing machine. The continued operation of the sewing machine after the garment part has passed the sewing needle is necessary to ensure that the stitching in the garment part has been completed and the thread chain extending off the garment part ensures that the stitching in the garment does not unravel. Typically, the trailing thread chain is severed after the garment part has moved beyond the sewing needles, leaving a tail of thread chain extending from the rear of the garment part, as well as leaving some excess thread chain extending from the sewing needle that will become attached to the next garment part that passes through the sewing machine.

Most semi-automatic, overlock stitch, sewing machines have one or more sewing needles for creating the thread chain, a presser foot, a throat plate, a chaining tongue, feed dogs, a motor, a foot treadle switch for engaging the sewing machine and other components and controls necessary for operation. The presser foot is used to hold the garment part down against the surface of the throat plate and against the cyclical motion of the feed dogs. The throat plate has slots through which feed dogs engage the garment part as the sewing action progresses, thereby advancing the garment part. The chaining tongue normally is formed as part of the throat plate, and acts as a knitting needle around which the thread chain is formed.

It has been known in the art to trim excess thread chain extending from the rear of the garment part with the use of a vacuum knife. In such known arrangements, a scissors-type cutter is arranged so that the knife blades are adjacent and parallel to the path of travel of the garment through the sewing machine. The knife blades are positioned in front of and to one side of an opening to a relatively large vacuum conduit (the diameter of the vacuum conduit is much greater than the thickness of the thread chain). As the garment part passes by the vacuum knife, the stream of air drawn through the vacuum conduit induces a length of the thread chain extending in a relaxed condition from the rear of the garment part to move into the vacuum conduit. The thread chain extending from the rear of the garment part is thereby extended across the knife blades and the blades trim the thread chain to an acceptably short length extending from the trailing edge of the just sewn garment part. This trimming of the thread chain also leaves a length of thread chain extending from the sewing needle and loops about the chaining tongue and into the sewing area of the sewing machine.

To prevent the excess thread chain that extends from the needles of the sewing machine from being attached haphazardly to the leading edge of the next oncoming garment part and spoiling the appearance of the next succeeding garment part as the garment is sewn, it is desirable to position this excess thread chain so that it will be oversewn or "latched back" into and substantially hidden by the stitching formed in the next garment part precisely at the beginning of the stitching in that garment part. In the absence of such a "latch back" operation, the excess thread chain creates a knot or chain of threads that extends from the leading edge of the subsequent garment part, and the excess thread chain may have to be trimmed away from the garment, which requires additional time and tends to weaken the stitched seam.

There are prior art disclosures which address the problem of positioning and oversewing the excess thread chain extending from the needles of the sewing machine into the subsequent garment part. For example, U.S. Pat. No. 4,679,515 of Keeton describes an apparatus which works to oversew the excess thread chain by severing the thread chain, blowing the free end of the thread chain extending from the sewing needles around and away from the sewing area with a stream of air, and snagging the excess thread chain with a mechanical finger or other means, thereby holding the thread chain in such a position that it should be oversewn into the next garment part. However, there are certain practical difficulties with this type arrangement, most notably the difficulty in correctly positioning the beginning of the excess thread chain at the very beginning of the next garment part. Another shortcoming of the prior art is that the mechanical device does not always snag the excess thread chain successfully, making the apparatus inefficient to use in a high production environment. Such prior art further requires a relatively large number of moving parts to perform the latch back sewing function, while generally a device which has fewer moving parts tends be more reliable and simpler to construct and maintain.

U.S. Pat. No. 4,038,933 of Marforio discloses a sewing machine with a vacuum operated device for latching back excess thread chain at the beginning of forming a chain stitch in a garment. Marforio discloses a vacuum knife for severing the thread chain and a hollow chaining tongue for drawing therein the severed thread chain extending from the needles by applying a vacuum to the hollow chaining tongue. Devices made according to the teachings of Marforio generally fail to latch back thread chains into the chain stitch of the next garment with a high degree of reliability at least in part because Marforio does not disclose a means for ensuring that the thread chain that would be drawn into the hollow chaining tongue is of a predetermined length. Applicant has discovered that if the thread chain to be drawn into the hollow chaining tongue is too long, it cannot be drawn into the hollow chaining tongue reliably. Also, if the thread chain to be drawn into the hollow chaining tongue is too short, it may be too stiff to respond to the stream of air that attempts to turn the thread chain toward the chaining tongue and the short thread chain can become unraveled, producing a weakened and unattractive latch back stitch. Marforio discloses using a Venturi air flow inducement constriction to create a source of reduced pressure for drawing the severed thread chain with an air stream into the hollow chaining tongue. Such an arrangement generally is not desirable because this type system usually creates a loud noise in operation from consuming large volumes of compressed air to create the desired air stream and from a failure to produce a large enough volume of air flow through the hollow chaining tongue to move the excess thread chain into the hollow chaining tongue.

Thus, it is seen that a need exists for a sewing machine assembly which will "latch back" leftover thread chain severed from a previously sewn garment part and extending from the sewing needles precisely at the beginning of the stitching of a second garment part, while maintaining a high degree of reliability of operation.

SUMMARY OF THE INVENTION

Briefly described, the present invention comprises a process and apparatus for oversewing onto an oncoming garment part or other work piece the leftover thread chain extending from the sewing machine needle of an overlock stitch sewing machine which has been severed from a previously sewn garment part. A feature of the preferred embodiment of the invention is that the free end portion of the excess thread chain cut from the previous garment part and extending from the sewing needles is cut to a predetermined length and is drawn off by an air stream into a hollow chaining tongue of the throat plate of the sewing machine, and the thread chain is held there by the stream of air until the next garment part is engaged by the sewing needles, whereupon the free end portion of the chain stitch is progressively pulled from the inside of the hollow chaining tongue and sewn into the stitch formed in the next garment part. By cutting the thread chain extending from the sewing needles to a predetermined length prior to inducing the thread chain to be drawn into the hollow chaining tongue, the thread chain is drawn into the chaining tongue with a very high degree of reliability. Preferably, the knife that cuts the thread chain is positioned ½ to 1½ inches from the sewing needles so as to cut the thread chain to the desired length that is long enough to be flexible and turn with the stream of air toward the hollow chaining tongue, yet short enough to be moved by the stream of air and not unravel.

Another feature of the preferred embodiment of the invention is that the thread cutter provided for cutting the thread chain to the specified length is oriented to be perpendicular to the path of travel of the garment part through the sewing machine. The thread cuter includes knife blades positioned across the path of the thread chain extending between the rear edge of the previously sewn garment part and the sewing needles so that the thread chain can be made taut as the thread chain is being cut. This is important because the thread chain has a certain degree of resiliency and upon cutting the taut thread chain, the now severed thread chain portions tend to spring back away from the position where the cutter severed the thread chain and toward the opposite ends of the thread chain. Thus, the portion of the thread chain extending from the sewing needles toward the cutter springs back or recoils toward the sewing needles. This recoil action of the cut thread chain moves the cut thread chain toward the hollow chaining tongue in a relaxed, flexible condition and helps introduce the thread chain into the hollow chaining tongue.

As the first garment part is completed and is moved away from the sewing area, and after a delay for a selected number of stitches or a selected length of time to allow for the first garment part to be completely clear of the sewing area, the thread cutter is activated to sever the excess thread chain at a position between the previously sewn garment part and the needles of the sewing machine. At the same time that the knife is activated, the hollow chaining tongue in the throat plate is exposed to reduced air pressure causing a stream of air to enter the hollow chaining tongue, making it function as a suction tube. This causes the free end of the excess thread chain extending from the needles of the sewing machine to be drawn off into the hollow chaining tongue which is located where the sewing action takes place. As described above, this is aided by the recoil of the thread chain upon cutting. During the time that the chain stitch passage of the hollow chaining tongue is exposed to reduced air pressure and the stream of air enters the hollow chaining tongue, the sewing action of the sewing machine is continued for a small number of stitches to agitate the thread chain extending from the needles and the chaining tongue to help the excess thread chain to be drawn into the hollow chaining tongue by overcoming the stiffness of the thread chain. This continued sewing action also makes sure that the threads extend from the needles and about the chaining tongue, so that the proximal end of the excess thread chain physically surrounds the chaining tongue. The sewing action is then halted and the stream of air is terminated until the operator feeds the next garment part to the sewing needles of the sewing machine, with the presser foot up or down depending upon the nature of the articles to be made, and the operator engages the foot switch to start the sewing action.

As the sewing action begins for the next garment part the air stream into the hollow chaining tongue is established and additional excess thread chain is likely to be created about the chaining tongue before the sewing needle first engages the garment part. This additional excess thread chain also is formed about the chaining tongue. As the oncoming garment part approaches the sewing needles, the excess thread chain still wrapped about the chaining tongue will be pushed off the distal end of the chaining tongue and drawn into the hollow chaining tongue by the air stream. This drawing off of the additional excess thread chain continues until the sewing needles first engage the next garment part and the threads are formed into an overlock stitch in the leading edge of the garment part, at which point the garment part itself begins to draw the excess thread chain back out of the hollow chaining tongue against the direction of the stream of air entering the hollow chaining tongue into a position along the lower surface of the garment part.

As the sewing of the garment part progresses, the stitches are first formed about the chaining tongue so that as the excess thread chain is pulled by the moving garment part out of the chaining tongue the stitching slips off the end of the chaining tongue and surrounds and captures the excess thread chain adjacent the lower surface of the garment part. As the garment part progresses through the sewing machine this process of drawing the excess thread chain back out of the hollow chaining tongue continues until all of the excess thread chain is drawn back out of the hollow chaining tongue and is oversewn or "latched back" into the garment part. The air stream is terminated shortly after the sewing machine starts its sewing function so that the thread chain is progressively but gently pulled from the hollow chaining tongue against the flow of the stream of air entering the chaining tongue during the initial sewing function yet the requirements of the vacuum system to maintain the air stream is minimized when the thread chain has been pulled out of the chaining tongue by terminating the movement of air into the chaining tongue.

Another feature of the invention is that the hollow chaining tongue is connected in fluid communication to a suitably sized vacuum canister, with the vacuum canister being at least partly evacuated by a low-volume, low-noise vacuum generator. The vacuum canister acts as a reduced pressure reservoir which makes a large volume of reduced pressure air available from the low capacity vacuum generator for causing the thread chain to be drawn within the hollow chaining tongue.

Thus, it is an object of this invention to provide a system for producing high quality stitching and seams in garments and other work products.

Another object of this invention is to provide an improved system for forming "latch back" overlock stitching in garments and similar work products with a high degree of reliability.

Another object of the invention is to provide more attractive leading seams in garments and the like in that the seams are free of any knots of threads or thread chains.

It is another object of this invention to provide a system for producing high quality chain stitching in garments and the like while permitting workers with less experience and skill to produce the quality garments and articles. This is accomplished by virtue of the fact that the operator need not position the garment to be sewn in any particular manner in order to achieve a proper latch back stitch. Rather, the apparatus ensures that the latch back stitch is properly positioned.

It is another object of this invention to provide higher production rates in the fabrication of garments and the like by eliminating the need for trimming leading knots of threads and thread chains from garments.

Other objects, features and advantages of the invention will become apparent upon reading the following specification when taken in conjunction with the accompanying drawings.

DETAILED DESCRIPTION OF PREFERRED EMBODIMENTS

Figure 1:
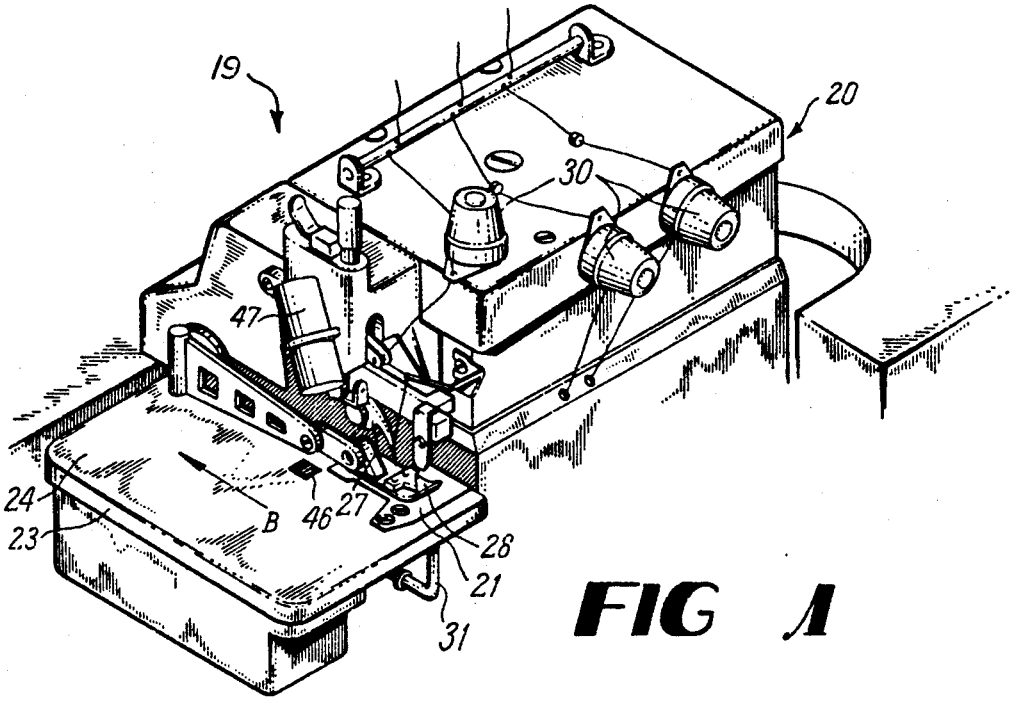
FIG. 1 is a top, front perspective view of a overlock stitch sewing machine according to a preferred form of the invention.

Referring now in more detail to the drawings, in which like reference numerals indicate like parts throughout the several views, FIGS. 1–7 show a preferred embodiment of the present invention comprising a semi-automatic overlock stitch sewing machine assembly 19 of the type that creates a stitch 15 that is known as a "serging", "overlock" or "504" stitch (Stitch Type 504, Federal Standard Stitches, Seams, and Stitchings). The sewing machine assembly 19 conventionally comprises a sewing machine 20 mounted in a cover plate or sewing table 23, with sewing machine including a sewing needle 27 for creating the stitching, a throat plate or needle plate 21, a presser foot 28, and a foot treadle (not shown) to allow the operator to engage and disengage the drive motor (also not shown) of the sewing machine. The sewing table 23 conventionally lies in a horizontal orientation, and has an upper surface 24 which functions as a work surface, over which garment parts or other work products pass in a direction of travel indicated by direction arrow B.

Figure 5:
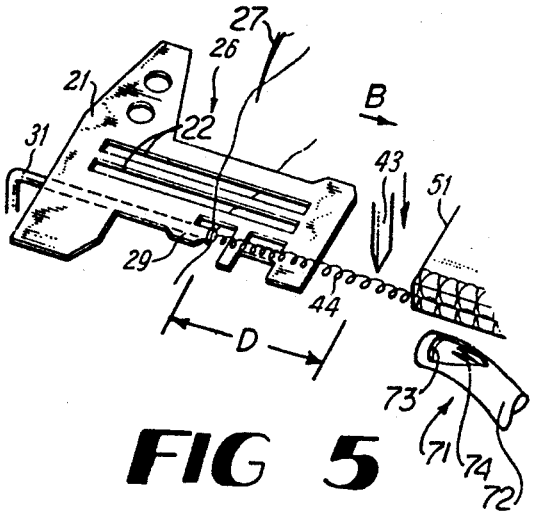
FIG. 5 is a perspective illustration of the throat plate of the sewing machine of FIG. 1, illustrating a work product as it moves beyond the thread plate.

As illustrated in FIG. 5, throat plate 21 includes a chaining tongue 29, around which the sewing needle 27 and lower sewing needles 27' form an overlock stitch. It is noted that the term "lower sewing needles" refers to the conventional loopers utilized in an overlock sewing machine. Feed dogs (not shown) engage the garment through slots 22 in the throat plate 21 and act to advance the garment as the sewing progresses. The presser foot 28 (FIG. 1) acts to press the garment down against the throat plate 21 so that the feed dogs cyclically engage and advance the garment between downward strokes of the needle 27, allowing a uniform stitch to be produced. Thread is supplied to the sewing needle 27 and to loopers (not shown) from tension devices 30 (FIG. 1) for sewing work products as they are passed through the sewing area 26.

Figure 2:
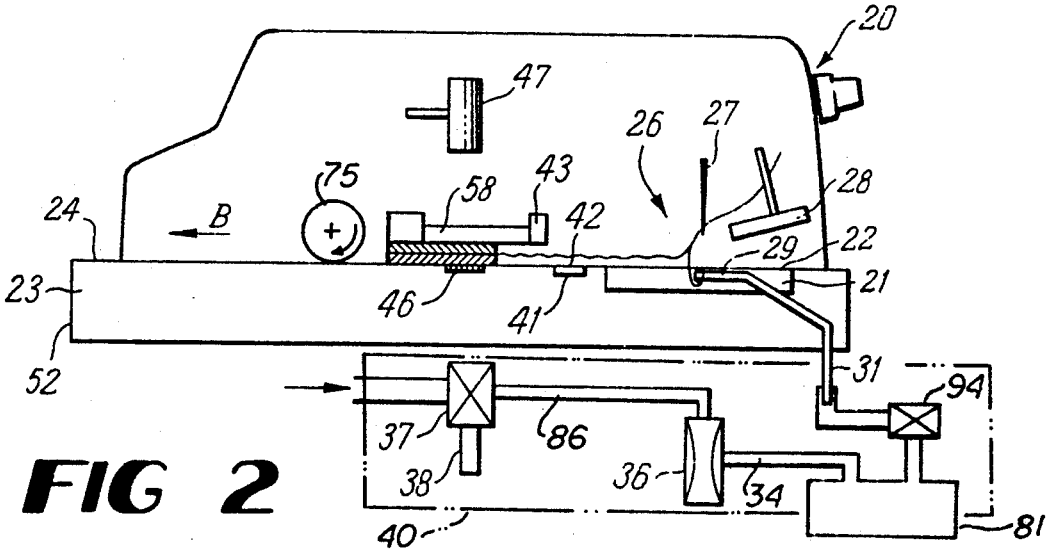
FIG. 2 is a schematic side elevational view of the sewing machine of FIG. 1, illustrating the air flow control system that communicates with the hollow chaining tongue.

FIG. 2 schematically shows a portion of the air flow system of the embodiment of FIG. 1 including a throat plate 21 and its hollow chaining tongue 29, a suction tube 31 which communicates with the chaining tongue 29, a constricted conduit section indicated schematically at 36 and generally referred to as a Venturi for providing a source of reduced air pressure to suction tube 31 and the hollow chaining tongue 29, cutting means 41 and 43, and sensing means 46 and 47. Suction tube 31 is fixedly attached to the bottom of the throat plate 21 opposite the top surface of the throat plate over which garments pass as they are sewn. The work surface of the sewing table 23 lies in a horizontal orientation adjacent and parallel to the throat plate 21. The throat plate 21 is located in the sewing area 26 and is coextensive with sewing table 23 and also lies in a horizontal orientation.

As shown in FIG. 5, the distal portion of the suction tube 31 merges into and functions as, a chaining tongue 29 of the throat plate. At the distal end of the chaining tongue 29 furthest along the direction of arrow B there exists an opening into which air and severed excess thread chain is drawn. The sewing needle 27 and the loopers operate in the sewing area 26 to form an overlock stitch around the outer surfaces of the chaining tongue 29 in a well known manner.

As schematically illustrated in FIG. 2, the suction tube 31 extends from hollow chaining tongue 29 of the thread plate 21 and is connected to, and in fluid communication with, a conduit 34. Conduit 34 is connected to, and in fluid communication with, an air control means 40 for intermittently applying a reduced pressure to the hollow chaining tongue 29 and inducing a stream of air to flow into the hollow chaining tongue. In a simple form, air control means 40 comprises a Venturi 36 air flow inducement constriction connected to a source of compressed air by means of valve 37 and solenoid 38. A preferred form of air control means 40 will be discussed in more detail below with reference to FIGS. 6 and 7.

Figure 3:
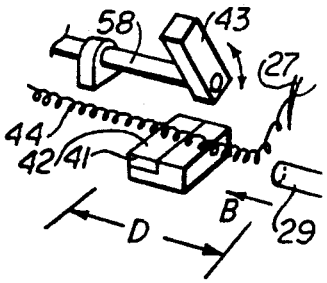
FIG. 3 is a schematic, perspective illustration of the thread chain cutter mechanism of the sewing machine of FIG. 1.

As shown schematically in FIG. 2, a stationary knife edge 41 is located across the path of the garment parts as the garment parts pass through the sewing machine, in the direction indicated by arrow B from the sewing needle 27. Stationary knife 41 has an upper exterior surface 42 coextensive with the upper surface 24 of the cloth cover plate 23. A movable knife 43 is mounted adjacent to and above the path of the garment parts and above stationary knife edge 41. Knife 43 is fixedly attached to a shaft 58 which rotates about its longitudinal axis to create rotary cutting motion in the knife 43. As shown in FIG. 3, stationary knife 41 and movable knife 43 are positioned to straddle the excess thread chain 44 extending from the trailing edge of a previously sewn garment part and the sewing needle 27. Furthermore, knives 41 and 43 are oriented to cut the thread chain 44 perpendicular to the direction of travel B of the garment parts through the sewing machine. With this construction, the excess thread chain 44 can be drawn taut between the needles 27 and the previously sewn garment part for cutting by the knives 41, 43 and upon cutting, the now severed end portions of the thread chains recoil away from each other and away from the knives. This recoil action tends to help introduce the severed portion of the thread chain extending from the sewing needle into the hollow chaining tongue. Thus, the knives 41, 43 function as a thread chain severing means.

Figure 4:
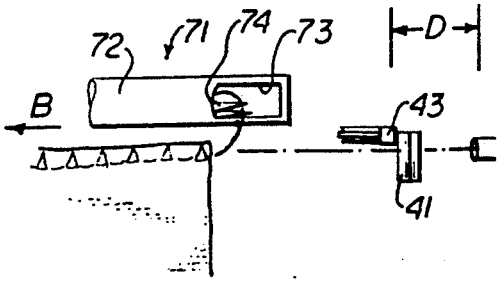
FIG. 4 is a schematic plan view of the thread cain trimmer of the sewing machine of FIG. 1.

As shown in FIGS. 3-5, the knife blades 41, 43 are positioned a predetermined distance D from the distal open end of the hollow chaining tongue 29. Preferably, this predetermined distance D is 1 inch. Applicant has found that a range of distances of between ½ inch and 1½ inches appears to work satisfactorily. The optimal distance D from the cutting knives to the open end of the hollow chaining tongue can vary with several factors including the stiffness of the thread, the thickness of the thread, the inside diameter of the passage through the hollow chaining tongue and the difference between atmospheric pressure and the reduced air pressure applied to the hollow chaining tongue. The distance D is important in that as the knives 41, 43 are operated to sever the excess thread chain 44 extending from the sewing needle 27 to the trailing edge of the previously sewn garment, the knives create a severed trailing thread chain extending from the trailing edge of the previously sewn garment and a severed leading thread chain of a predetermined length extending from the sewing needle. Applicant has found that if the leading thread chain extending from the sewing needle is too long, it cannot be drawn within the hollow chaining tongue reliably. On the other hand, if the leading thread chain extending from the sewing needle is too short, the thread chain may be too stiff to turn toward the hollow chaining tongue or the thread chain can become unraveled, tending to produce an unattractive latch back stitch or a weakened latch back stitch.

The electric eye reflector surface or target 46 lies in the plane of the cloth cover plate 23 along the direction indicated by arrow B from both the sewing needle 27 and the knife edges 41 and 43. The electric eye 47 is located above and directed toward the reflector surface 46. The electric eye generates a signal for controlling the knife 41, 43 and other elements of the system in response to the detection of a change in light reflection from the reflector surface 46 caused by a garment part passing between the eye and its reflector surface.

As illustrated in FIGS. 4 and 5, a vacuum trimming knife indicated generally at 71 is positioned adjacent the path of travel of the garment parts through the sewing machine for trimming the severed trailing thread chain extending from the trailing edge of the previously sewn garment parts. The vacuum trimming knife 71 includes a conduit 72 adapted for connection to a source of reduced air pressure, the conduit 72 having a relatively large opening 73. A scissors type knife 74 is mounted within the conduit 72 adjacent and partially obstructing the opening 73. With this construction, as a previously sewn garment is moved past the vacuum trimming knife 71 after the excess thread chain extending between the trailing edge of the previously sewn garment and the sewing needle has been severed by the knife 41, 43, the trailing thread chain extending from the trailing edge of the previously sewn garment is flexible and is easily drawn into the conduit 72 through the opening 73, and as the previously sewn garment continues to be moved in the direction of direction arrow B, the scissors type knife 74 trims the trailing thread chain very close to the surface of the previously sewn garment.

It will be noted that while the vacuum trimming knife 71 is well suited to trimming a limp trailing thread chain extending from the trailing edge of the previously sewn garment, it is not well suited to cutting the taut excess thread chain 44 to create a leading thread chain extending from the needle of a predetermined length. This is so because the vacuum trimming knife is of a type to be arranged adjacent and parallel to the path of travel of the garment through the sewing machine and depends upon vacuum to draw a limp excess thread chain out of its ordinary path and partly into the conduit 72. As it does this, the vacuum knife pulls a loop of the excess thread chain into the conduit and the knives of the vacuum trimming knife tend to cut only one side of the loop, while the other side of the loop continues to be drawn in to the conduit but not directly to the cutter in the conduit. Thus, this vacuum trimming knife, if used to sever the excess thread chain 44, tends to create a leading thread chain extending from the sewing needle of an uncontrolled length, and often this uncontrolled length of thread chain is too long to be reliably drawn within the hollow chaining tongue. Also, the vacuum of the thread chain cutter would tend to work against the vacuum of the hollow chaining tongue, causing the stream of air moving toward the chaining tongue to be less effective to draw the thread chain to its latched back position.

As illustrated in FIG. 2, a traction roller 75 is positioned further along the path of movement of the garment part beyond the sewing area, and rotates in the direction indicated by its arrow to engage at its lower portion of the garment part and to pull the garment part on beyond the sewing area. The traction roller normally is operated in timed relationship with the sewing machine and when the electric eye 47 detects the trailing edge of the garment part the peripheral velocity of the traction roller is increased and becomes greater than the linear velocity of the garment part as the garment part passes through the sewing area. This causes the garment part to move rapidly away from the sewing area after the trailing edge of the garment part has moved beyond the control of the feed dogs and presser foot, causing the thread chain extending from the needles to the garment part to be stretched. This applies tension to the uncut thread chain.

The function of accelerating the movement of the garment part beyond the sewing area so as to stretch the thread chain also can be performed by hand, by the operator rapidly moving the garment part out of the sewing area after the sewing step has been completed.

Figure 6:
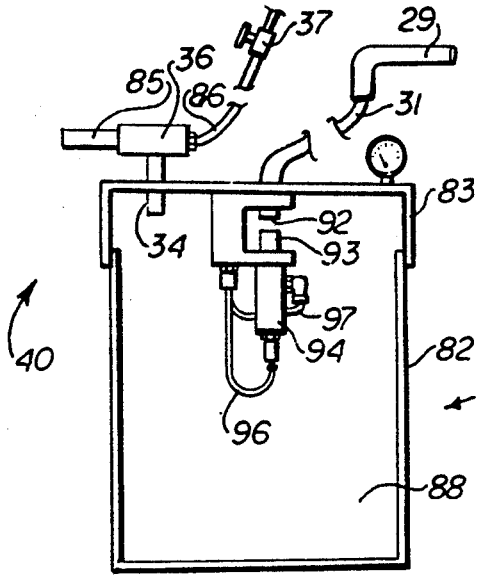
FIG. 6 is a schematic illustration of the vacuum reservoir and associated valve and conduits which are used with the sewing machine of FIG. 1.

As shown in FIG. 6, the means 40 for providing reduced pressure to the hollow chaining tongue 29 preferably comprises a large vacuum reservoir indicated at 81. Vacuum reservoir 81 is a cylindrical canister and includes a cylindrical lower portion 82 and a suitably sized cap 83. A Venturi air flow inducement constriction 36 is connected to a source of pressurized air through conduit 86 and valve 37 for evacuating an interior region 88 of the vacuum reservoir 81 through conduit 34. The Venturi 36 is a low noise, low volume unit for creating relatively strong vacuum in the interior region 88. The venturi 84 is muffled by a muffler 85.

Figure 7:
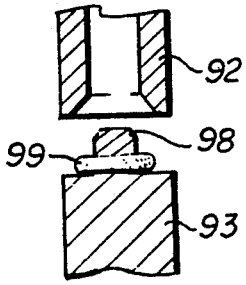
FIG. 7 is a detail illustration of the air flow control valve of the reservoir of FIG. 6.

As shown in FIGS. 6 and 7, the conduit 31 terminates in a valve port 92 inside the vacuum reservoir. The valve port 92 is selectively covered and uncovered by a push rod 93 of a two-stage air actuated cylinder 94. A first air pressure line 96 is connected to the air cylinder 94 for extending the push rod 93 for closing the valve port 92 and a second air pressure line 97 is connected to the air cylinder for retracting the push rod for uncovering the valve port 92. As shown in FIG. 7, the end of valve port 92 includes tapered opening for receiving an extension portion 98 for reaching up into the interior of the valve port for aligning and sealing the push rod 93 with the valve port 92 to substantially seal the valve port. For this purpose, a rubber 0-ring 99 is provided to insure a pressure-tight seal.

Figure 8:
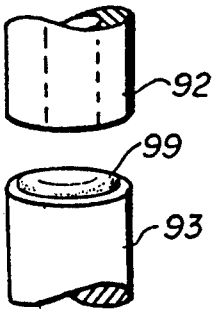
FIG. 8 is an alternate embodiment of the air flow control valve of FIG. 7.
Figure 10:
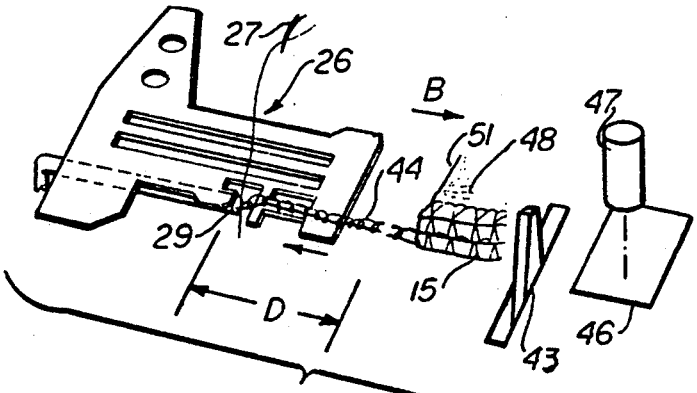
FIGS. 10 through 14 are perspective views of the throat plate in the sewing area of the sewing machine depicting the sequence of events according to the method and apparatus of the invention.
Figure 11:
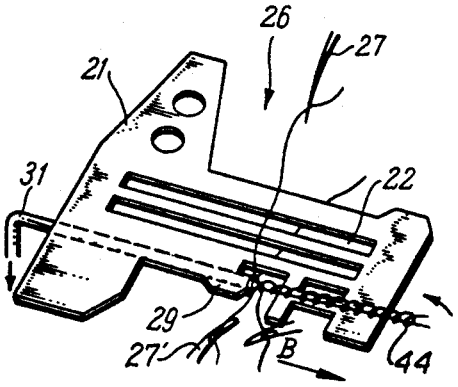

A shown in FIG. 8, the push rod can be made to have a flat top surface and the 0-ring 99 can be used to seal against a flat annular surface of the valve port 92.

Figure 9:
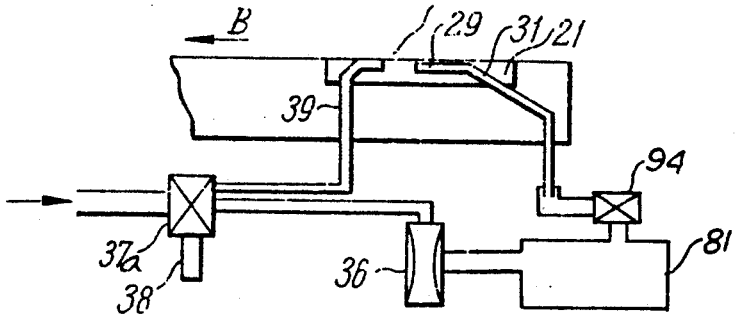
FIG. 9 is a schematic view of an alternate embodiment of the air flow control system of FIG. 2.

FIG. 9 is a schematic illustration of a portion of the sewing machine in another form of the present invention, wherein a blow tube 39 provides additional means of urging the severed leading thread chain toward the suction tube 31. Blow tube 39 is located in the throat plate 21 proximate to, and facing, the suction tube 31. The blow tube 39 is connected to a source of compressed air by means of valve 37*a* and solenoid 38.

OPERATION

Referring to FIGS. 10–15, as a first garment part 48 (FIG. 10) is moved in the direction of arrow B, stitches 15 are formed in the garment part 48 by the action of the sewing needles 27, etc. and, when the trailing edge 51 of the first garment part exits the sewing area 26, the stitch continues to be formed and a thread chain 44 extends from the trailing edge 51 of the garment part 48 back toward the chaining tongue 29 and sewing needle 27. As the first garment part is moved further away from the sewing area 26 and toward the back edge 52 of the machine 20, the trailing edge 51 of the garment part 48 uncovers the electric eye target 46, thus activating the electric eye 47. The electric eye 47 creates a signal to begin a sequence of events.

The movement of the garment part 48, by hand or mechanically by the traction roller 75, is faster as the garment part leaves the sewing area 26 than the normal speed of advancement of the garment part as it is engaged by the presser foot and feed dogs. This causes the thread chain that continues to be formed by the sewing needles to be stretched as the garment moves away from the sewing area 26.

Once the trailing edge 51 of the garment part passes the photocell 47, the knife blade 43 of the thread chain cutter means is actuated so as to cut the thread chain 44 at a predetermined distance from the sewing area 26. In the mean time, the operation of the sewing machine will have continued for a short duration so as to allow the cutting function to occur while the sewing machine is still operating. In some instances, the operation of the sewing machine will have terminated for a short spell until the cutting of the thread chain has been or is about to be accomplished, and is resumed for a short duration. This will assure that the proximal end of the thread chain will be formed about the chaining tongue 29, so that the thread chain 44 begins at the hollow end of the chaining tongue.

Valve 94 (FIGS. 2 and 6) also is activated by the photocell 47. This exposes the hollow chaining tongue 29 to the reduced air pressure of the vacuum reservoir 81, causing a stream of air to be induced into the open end of the chaining tongue 29. The stream of air flowing from in front of the opening of the hollow chaining tongue 29 induces the now cut thread chain 44 (FIG. 11) to move into the hollow chaining tongue. The combination of the effect of the stream of air moving into the open end of the chaining tongue, the backward springing movement or "spring back" action of the thread chain 44 and the predetermined length of the now cut thread chain all cooperate to cause the thread chain 44 to be sucked into the hollow end of the chaining tongue 29. Further, the continued operation of the sewing machine during the critical time of just before and just after the step of cutting the thread chain assures that the proximal end of the thread chain is located at the opening of the chaining tongue, and also imparts a movement to the now cut thread chain so that the thread chain is more likely to "wag" in the air stream, much like the tail of a dog wags. This wagging movement tends to assure that at least the intermediate portion of the now cut thread chain will be drawn by the air stream toward the chaining tongue, and the entire cut end of the thread chain will move into and become everted inside the hollow chaining tongue 29. Further, the continued movement of the air stream assures that once the thread chain has entered the chaining tongue, the thread chain will be drawn to its full length inside the chaining tongue (FIG. 12).

Figure 12:
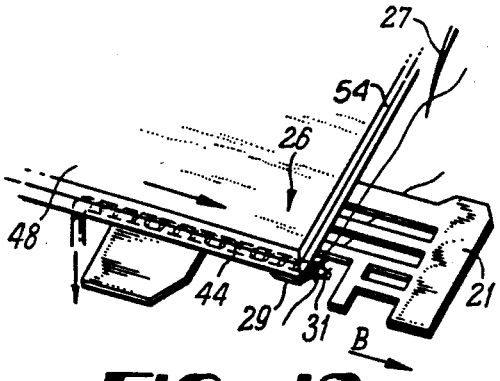
Figure 13:
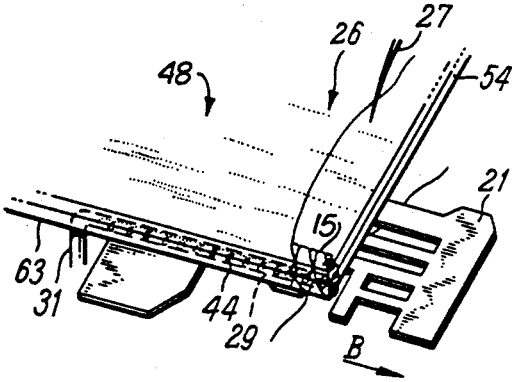

As illustrated in FIG. 12, when the next garment part 48 moves into the sewing area 26 over the throat plate 21, the thread chain 44 will extend at its proximal end about the external surface of the chaining tongue, and its intermediate portion and distal end will be inside the hollow chaining tongue. As the next oncoming garment part 26 moves to the position of the chaining tongue and sewing needle 27, the operator activates the motor of the sewing machine so that the feed dogs and presser foot will cooperate to bring the leading edge of 54 of the garment part on into the sewing area. This causes the sewing machine to form several stitches just prior to the leading edge 54 reaching the sewing needle 27. This further assures that the thread chain will be established about the chaining tongue 29 when the garment part reaches the sewing needle 27.

Once the garment part 26 reaches the sewing needle 27 (FIG. 13), a chain stitch 15 begins to be formed in the edge of the garment part 26, connecting the plies of material together along their aligned edges. In most instances (not shown) a cutter will trim the longitudinal edges of the garment part just prior to moving into the sewing area 26.

As the leading edge 54 of the garment part moves through the sewing area 26 and the chain stitch 15 is formed in the garment, the thread chain 44 positioned inside the chaining tongue 29 will be pulled by the moving garment parts progressively out of the chaining tongue 29. Since the thread chain is formed physically about both the longitudinal edge of the garment parts 48 as well about the chaining tongue 29, the free end portion of the thread chain 44 will progressively become surrounded by the chain stitch 15 on the lower surface of the garment part 54, and as the garment part 48 progressively moves through the sewing area 26, the thread chain 44 is progressively pulled out of the chaining tongue, until the entire thread chain has been surrounded by and sewn into the chain stitch 15, thereby forming a "back latch" of the thread chain in the overlock stitch.

Figure 14:
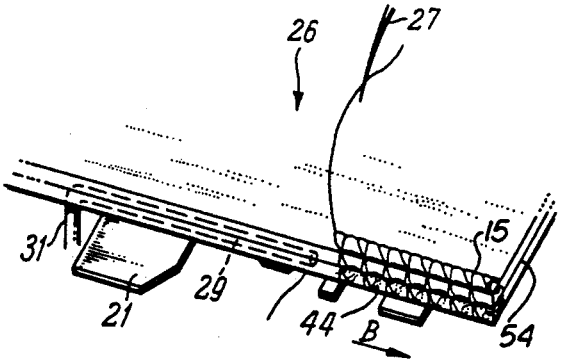

FIG. 14 represents the continued movement of the garment part 48 through the sewing area 26 after the thread chain 44 has been latched back within the overlock stitch 15.

Figure 15:
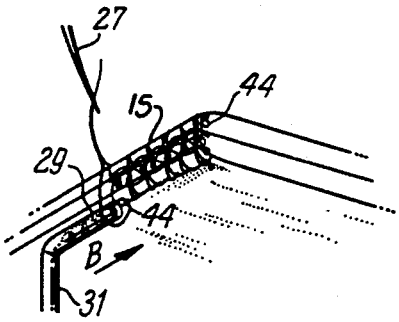
FIG. 15 is a bottom, rear perspective view of the seam near the leading edge of an exemplary article produced according to the method of the invention.

FIG. 15 illustrates the progressive movement of the thread chain 44 out of the opening of the chaining tongue 29 during the formation of the overlock stitch 15.

As illustrated in FIG. 6, the vacuum canister 81 is of relatively large capacity, preferably more than 2000 cubic inches, and the valve 94 functions to draw completely away from the valve port 92, permitting free access of the lint, dust and other particulate matter typically carried with the air stream from the chaining tongue 29. The valve port and valve plunger are self cleaning in that the air stream flowing from the valve port 92 tends to blow away any dust, lint, etc. that might otherwise tend to accumulate in the valve port or on its plunger. Also, the dust, lint, etc. tends to fall to the bottom of the chamber 88 and the large capacity of the chamber 88 tends to permit the dust, lint, etc. to rest in the lower portion of the chamber.

The valve 94 functions during each cycle of operation of the sewing machine to cause the thread chain 44 to become latched back in the overlock stitch of the garment part, with the valve functioning to open and communicate the lower air pressure of the chamber with the chaining tongue 29. In the mean time, valve 37 is opened and closed independently of the operation of valve 94, and typically will be opened and closed in response to the detection of high and low pressure within the vacuum chamber 81. The opening of valve 37 causes a stream of high velocity air to move through the Venturi 36, which draws air from the chamber 88, thereby reducing the pressure within the chamber 88.

As illustrated in FIG. 9, a blow tube 39 can be utilized in combination with the hollow chaining tongue 29. Blow tube 39 is mounted so that its distal end including its outlet opening are part of the throat plate 21, and the blow tube 29 communicates with valve 37*a* of the air flow control system. When the valve 37*a* is actuated, a stream of air is emitted from blow tube 39 toward hollow chaining tongue 29. This positively directed stream of air pushes the free end of the thread chain 44 extending from the needles and from the chaining tongue back toward the chaining tongue, so as to assist in turning the threads toward the chaining tongue, and to place the free end of the thread chain in the vicinity of the air stream flowing into the hollow chaining tongue. In this instance, valve 37*a* will be actuated in unison with the actuation of valve 94 in response to the signal provided by the photo cell 47, determining the presence and absence of the garment part as the garment part moves across the throat plate in the direction as indicated by arrow B. Also, valve 37*a* can be opened in response to the detection of an increase in pressure within reservoir 81, so as to evacuate the reservoir.

Thus, it can be seen that the present invention comprises a useful and effective method and apparatus for oversewing or forming a "latch back" of the excess thread chain into a garment. While the invention has been shown and described as what is presently believed to be the most practical and preferred embodiments thereof, it will be apparent that modifications and variations within the scope and spirit of the invention are possible, and that the invention is to be afforded its broadest interpretation so as to encompass all equivalents thereof. For example, it is possible to use other type cutting means rather than the specific cutters disclosed herein for cutting and trimming the thread chain. Further, a human operator can initiate some of the latch back functions of the system instead of utilizing a photo cell detector, and the garment parts can be moved by hand or by an automatic feed system away from the sewing area at an increased rate of movement for the purpose of stretching the thread chain 44 and applying tension to the thread chain so that the ends of the thread chain will rebound in opposite directions after having been cut. Also, while the overlock stitch has been specifically designated herein as the type of stitch formed by the sewing machine, the latch back system can be used with other types of stitches, if desired.

We claim:

1. A sewing machine comprising:

a work surface at least partly defining a path of travel of a work piece through a sewing area of the sewing machine;

a chaining tongue in said sewing area;

sewing needles in the sewing area for sewing a continuous overlock stitch about said chaining tongue and into a work piece and forming excess thread chain between a trailing edge of a first previously sewn work piece and said sewing needles;

severing means for cutting the excess thread chain to create a severed leading thread chain extending from said sewing needles;

said chaining tongue defining an air passage therethrough and including an open end adjacent the sewing area for receiving the free end of the severed leading thread chain extending from said sewing needle and for positioning the free end of the leading thread chaining at a position to be oversewn into a second work piece;

airstream inducement means for inducing a stream of air to flow into said open end of said chaining tongue for drawing the free end of the leading thread chain into said chaining tongue as the severing means cuts the thread chain;

control means responsive to the movement of a work piece along the path of travel through the sewing area for terminating the sewing function of said sewing needles and for actuating said severing means to cut the thread chain before the sewing function has terminated so that the sewing needles continue to form the thread chain about the chaining tongue after the thread chain has been cut and as the airstream flows into the open end of the chaining tongue.

2. A sewing machine as claimed in claim 1 wherein said severing means is adapted for cutting the excess thread chain extending from said trailing edge of the first previously sewn work piece to the sewing needle with the excess thread chain stretched taut, whereby as the excess thread chain is cut, the severed leading thread chain recoils toward the open end of the hollow chaining tongue, thereby helping the leading thread chain to be drawn therein.

3. A sewing machine as claimed in claim 1 wherein said airstream inducement means for inducing a stream of air into the open end of said chaining tongue comprises a vacuum reservoir chamber, means for at least partly evacuating said vacuum reservoir chamber and valve means responsive to said control means for intermittently connecting said vacuum reservoir chamber to said hollow chaining tongue in timed relationship with respect to the movement of a work piece through the sewing area.

4. The sewing machine as claimed in claim 1 and further including means for stretching the thread chain extending from a previously sewn work piece to the sewing needle.

5. The sewing machine as claimed in claim 1 and further including means for advancing the work piece beyond the sewing area at a velocity that causes tension in the thread chain extending from the work piece to the sewing needle.

6. A sewing machine comprising: sewing needles in a sewing area for sewing a continuous overlock stitch or the like into a work piece moved through the sewing area whereby excess thread chain is created between a trailing edge of a previously sewn work piece and said sewing needles;

means for applying tension to the excess thread chain;

severing means for cutting the excess thread chain with the excess thread chain stretched taut to create a severed leading thread chain of a predetermined length extending from said sewing needle;

a chaining tongue positioned for receiving thereabout the chain stitch formed by the sewing needles and including an open end adjacent said sewing needles for receiving a free end of the severed leading thread chain extending from said sewing needles;

vacuum means for inducing a stream of air to flow into said chaining tongue and drawing the free end of the leading thread chain into said chaining tongue; and means for retaining one end of the excess leading thread chain about said chaining tongue after the severing means cuts the excess thread chain and as the excess thread chain is drawn into the chaining tongue.

7. A sewing machine as claimed in claim 4 wherein said severing means is spaced from said sewing needle a distance for forming a leading thread chain of a predetermined length.

8. A sewing machine as claimed in claim 7 wherein said predetermined length is between ½ inch and 1½ inches.

9. A sewing machine as claimed in claim 6 wherein said severing means is adapted to cut perpendicularly to a path of travel of the work piece through the sewing machine.

10. A sewing machine as claimed in claim 6 wherein said vacuum means comprises a vacuum canister, a means for creating a reduced air pressure in said vacuum canister, and control means for intermittently connecting said vacuum canister to said chaining tongue in timed relationship with respect to the movement of a work piece through said sewing area.

11. A sewing machine as claimed in claim 6 wherein said severing means is adapted to create a trailing thread chain extending from the trailing edge of a previously sewn work piece, said sewing machine further comprising vacuum knife means for trimming the trailing thread chain extending from the previously sewn work piece.

12. The sewing machine as claimed in claim 6 and further including a blow tube for directing a stream of air toward said chaining tongue.

13. An apparatus for use with a sewing machine, the sewing machine including sewing needles in a sewing area for sewing an overlock stitch or the like about a chaining tongue and into a work piece whereby a thread chain is created between a trailing edge of a previously sewn work piece and the sewing needles, said apparatus comprising;

means for applying tension to the thread chain extending between the previously sewn work piece and said needle, severing means for cutting the thread chain extending from the sewing needle to the previously sewn work piece while tension is applied to the thread chain to create a severed trailing thread chain extending from the trailing edge of the previously sewn work piece and a severed leading thread chain of a predetermined length extending form the sewing needle, and means for drawing off the free end of the severed leading thread chain extending from the sewing needle and for positioning the free end of the leading thread chain in a position to be oversewn into the beginning of the stitching in a second work piece, comprising a hollow chaining tongue including an open end adjacent the sewing area and means for inducing a stream of air to flow into said open end of said hollow chaining tongue in timed relationship with the cutting of the thread chain, whereby the free end portion of the leading thread chain extending from the sewing needle recoils from the severing means toward the chaining tongue and is drawn into the hollow chaining tongue by the stream of air.

14. An apparatus as claimed in claim 13 wherein the sewing machine includes a sewing table defining a path of travel of work pieces and wherein as a previously sewn work piece moves along said path of travel the thread chain extending from the trailing edge of the previously sewn work piece to the sewing needle is parallel to said path of travel, and wherein said severing means comprises cutting means positioned for straddling the thread chain.

15. An apparatus as claimed in claim 14 wherein said cutting means includes a stationary blade mounted in said sewing table and a second blade mounted for pivotal movement with respect to said stationary blade.

16. An apparatus as claimed in claim 14 wherein said cutting means are oriented perpendicularly to said path of travel.

17. An apparatus as claimed in claim 13 wherein said means for inducing a stream of air to flow into the open end of said hollow chaining tongue comprises a vacuum reservoir chamber, a Venturi means for creating a reduced air pressure in said vacuum reservoir chamber and valve means for intermittently connecting said vacuum reservoir chamber to said hollow chaining tongue.

18. An apparatus as claimed in claim 13 further comprising a means for detecting the completion of the sewing of a first work piece and generating a signal and means responsive to said signal for continuing and later halting the sewing action of the sewing machine and wherein said severing means is responsive to said signal for cutting the thread chain while the sewing action continues.

19. An apparatus as claimed in claim 18 wherein said sensing means for detecting completion of the first work piece comprises an optical detector means, said optical detector means being adapted to detect the trailing edge of the work piece.

20. An apparatus as claimed in claim 13 further comprising trimming means for trimming the severed trailing thread chain extending from the trailing edge of the previously sewn garment.

21. An apparatus as claimed in claim 20 wherein said trimming means comprises a vacuum knife positioned adjacent a path of travel of garments through the sewing machine.

22. An apparatus as claimed in claim 13 wherein said severing means is positioned at a distance from said chaining tongue between approximately ½ inch to 1½ inch.

23. A method of sewing a portion of a thread chain extending from the sewing needles of a sewing machine from a previously sewn work piece to a second work piece for eliminating a knot or thread chain protruding from the leading edge of the second work piece, said method comprising the steps of:

a. sensing the completion of sewing of the first work piece which has moved along a sewing path through the work area of the sewing machine as the sewing needles continue to operate to form the thread chain about a chaining tongue;

b. drawing taut the thread chain extending from the chaining tongue as the sewing needles continue to operate;

c. while the thread chain is taut, cutting the thread chain extending between the needles of the sewing machine and the first work piece in response to sensing the completion of sewing of the first work piece in a manner to create a leading thread chain of a predetermined length extending from the sewing needles;

d. as the sewing needles continue to operate drawing off the free end of the leading thread chain extending from the sewing machine needles into a hollow chaining tongue in such a manner as to cause the excess thread chain to extend below the path of the second work piece;

e. advancing the second work piece along the sewing path to the sewing machine needles as the sewing needles operate while the leading thread chain is drawn into the hollow chaining tongue until the second work piece is engaged by the sewing needles;

f. simultaneously sewing the second work piece and progressively oversewing the drawn off free end of the thread chain to the second work piece.

24. A method as claimed in claim 23 wherein the step of drawing off the free end of the leading thread chain comprises applying a source of reduced air pressure to the hollow chaining tongue during the step of cutting the thread chain.

25. A method of sewing excess thread chain extending from the sewing needles of a sewing machine to a work piece for eliminating a knot or thread chain protruding from the leading edge of the work piece, comprising the steps of:

a. forming an overlock stitch or the like about a chaining tongue and into a series of work pieces with the operation of sewing needles as the work pieces move along a sewing path beneath the sewing needles of the sewing machine;

b. sewing off a first one of the work prices to form a thread chain extending from a trailing edge of the first work piece to the sewing needles;

c. drawing taut the thread chain extending from the trailing edge of the first work piece to the sewing needles;

d. cutting the taut thread chain extending between the sewing needles and the previously sewn work piece at a predetermined distance from the sewing needles to create a predetermined length of leading thread chain extending from the sewing needles as the thread chain continues to be formed;

e. simultaneously with the step of cutting the taut thread chain inducing a stream of air into the chaining tongue to draw off the free end of the leading thread chain extending from the sewing needles into the chaining tongue to cause the free end of the leading thread chain to extend along the sewing path;

f. continuing the sewing action of the sewing needles and advancing a second work piece along the sewing path to the sewing machine while retaining the free end of the leading thread chain in the hollow chaining tongue until the second work piece is engaged in the sewing needles; and g. sewing the second work piece with the sewing needles while progressively pulling with the second work piece the free end of the leading thread chain from the chaining tongue and incorporating the leading thread chain into the chain stitch formed in the second work piece.

26. The method as claimed in claim 25 and wherein the step of drawing taut the thread chain comprises advancing the first one of the work pieces away from the sewing needle at a velocity greater than the rate at which the thread chain is formed.

27. In a latch back method of sewing a portion of excess thread chain created by the sewing of a first work piece as the first work piece exits the sewing area to a second work piece for eliminating a knot or thread chain protruding from the leading edge of the second work piece wherein a portion of the excess thread chain is positioned at the leading edge of the second work piece for oversewing, the improvement comprising the steps of forming an excess thread chain extending from the first work piece, drawing taut the excess thread chain extending from the first work piece to the sewing needles and chaining tongue of the sewing machine, cutting the taut excess thread chain to create a leading thread chain extending from the chaining tongue, drawing off the free end of the leading thread chain with a stream of air in such a manner as to cause the leading thread chain to be positioned proximate to the sewing needles for oversewing.

28. A method as claimed in claim 27 wherein the step of cutting excess thread chain to create a leading thread chain comprises cutting with cutting means for creating a leading thread chain of a predetermined length.

29. A sewing machine comprising:

sewing needles in a sewing area for forming an overlock stitch or the like into a work piece moved in spaced series through the sewing area whereby excess thread chain is created between the trailing edge of a previously sewn work piece and the sewing needles;

severing means for cutting the excess thread chain to form a severed leading thread chain of a predetermine length extending from the sewing needles;

a chaining tongue in said sewing area positioned for receiving thereabout the chain stitch formed by the sewing needle and including an air passage therethrough and an open end adjacent said sewing needles for receiving a free end of a severed leading thread chain;

vacuum means for inducing a stream of air to flow into the open end and through the air passage of said chaining tongue and drawing the free end of the leading thread chain into said chaining tongue; and control means responsive to the movement of a work piece beyond said sewing area for actuating said severing means to cut the excess thread chain and forming the severed leading thread chain, and for continuing the formation of the severed leading thread chain by the sewing needles about the chaining tongue until after the thread chain has been cut and as the vacuum means continues to induce a stream of air to flow into the open end of the chaining tongue.

* * * * *